US012454838B1

(12) United States Patent
Lackerdas

(10) Patent No.: US 12,454,838 B1
(45) Date of Patent: Oct. 28, 2025

(54) SWIMMING POOL SAFETY PIPE ASSEMBLY AND METHOD THEREFOR

(71) Applicant: John Lackerdas, Poway, CA (US)

(72) Inventor: John Lackerdas, Poway, CA (US)

( * ) Notice: Subject to any disclaimer, the term of this patent is extended or adjusted under 35 U.S.C. 154(b) by 0 days.

(21) Appl. No.: 19/282,847

(22) Filed: Jul. 28, 2025

(51) Int. Cl.
*E04H 4/12* (2006.01)
*E04H 4/06* (2006.01)

(52) U.S. Cl.
CPC ..... *E04H 4/1218* (2013.01); *E04H 4/06* (2013.01)

(58) Field of Classification Search
CPC ..... E04H 4/06; E04H 4/12; E04H 4/1209; E04H 4/1218; E04H 4/1245; E04H 4/16
USPC ..... 4/488, 490, 507, 541.1, 541.6
See application file for complete search history.

(56) References Cited

U.S. PATENT DOCUMENTS 2,910,009 A 10/1959 Fraser
4,348,281 A 9/1982 Perry
4,393,526 A * 7/1983 Miller ..... E04H 4/1681 4/490
D291,483 S 8/1987 Vassallo
4,817,991 A 4/1989 Frentzel
5,522,229 A 6/1996 Stuchlik, III
5,605,622 A 2/1997 Ferraro
6,233,756 B1 5/2001 Holbrook, Sr.
7,661,719 B1 * 2/2010 Nastri ..... F16L 5/00 4/507
2007/0089228 A1 * 4/2007 Sidler ..... E04H 4/1636 4/490
2021/0079678 A1 3/2021 Miller

FOREIGN PATENT DOCUMENTS

WO WO8810399 12/1988

* cited by examiner

*Primary Examiner* — Tuan N Nguyen

(57) ABSTRACT

A swimming pool safety pipe assembly includes a vacuum intake, a vacuum cover, a first vent intake, a second vent intake, and a cross pipe fitting. The vacuum intake, the first vent intake, and the second vent intake are designed to be mounted in a swimming pool wall. The cross pipe fitting includes a vacuum port, a first vent port, a second vent port, an exit port, and a tapered passage. The exit port is designed to be coupled to a pool pump to draw water from a swimming pool simultaneously into the vacuum intake, the first vent intake, and the second vent intake. The tapered passage is positioned in the exit port. The tapered passage is designed to receive and seat a tapered end of a vacuum hose inserted through the vacuum intake and into the cross pipe fitting.

17 Claims, 11 Drawing Sheets

SWIMMING POOL SAFETY PIPE ASSEMBLY AND METHOD THEREFOR

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to swimming pool flow equipment and more particularly pertains to a new swimming pool safety pipe assembly for minimizing cavitation in a pool pump and preventing injuries to swimmers, especially children. Swimming pools, especially inground pools, include suction ports built into the swimming pool wall. The suction ports powerfully draw in water, and some suction ports function as a vacuum intake to which a vacuum hose can be connected for flow of water to the pool filter. Such suction ports can be dangerous to swimmers, especially children, if hair or hands get caught in the suction port. In addition, when using the suction port as a vacuum intake, improper insertion or removal of the vacuum hose can result in a blockage or air being drawn in, which causes cavitation, that is, the pool pump being filled with air and not drawing sufficient water, which can destroy the pool pump if not stopped. The new swimming pool safety pipe assembly provides additional suction ports in the form of vent intakes that provide supplemental flow of water to alleviate suction force at the vacuum intake due to a blockage to prevent cavitation and allow swimmers to escape the suction force at the vacuum intake.

The new swimming pool safety pipe assembly can divert suction from a vacuum port to multiple vent apertures to promote child swimmer safety by removing or minimizing the risk of direct suction and entrapment potential that is evident with having a single vacuum suction port. It also solves the issue of pump cavitation when the pool vacuum hose is removed, eliminating the need to adjust the vacuum port valve when the vacuum hose is uninstalled from the wall of the swimming pool, which would normally cause the pump to cavitate and run dry. The new swimming pool safety pipe assembly therefore addresses some of the most common issues related to pool safety and function. The new swimming pool safety pipe assembly is useful in commercial and residential settings. Home owners can often cause the above problems when utilizing current vacuum systems, so the new swimming pool safety pipe assembly helps automatically compensate or correct for pump cavitation due to hose removal and accidental child entrapment from single point suction. The new swimming pool safety pipe assembly makes vacuum installations easier and less confrontational when installed and removed, and the vacuum valve can now be set once without the need for further checks or adjustments. The new swimming pool safety pipe assembly can be installed at time of replaster with minimal addition of fittings and pipe to existing single point installs, keeps commercial and residential pools in regulatory compliance, and increase swimmer safety, and promote a more pleasant experience in using and maintaining the pool.

(2) Description of Related Art Including Information Disclosed Under 37 CFR 1.97 and 1.98

The prior art relates to swimming pool flow equipment. The prior art, as best understood, does not disclose a swimming pool safety pipe assembly includes a vacuum intake, a vacuum cover, a first vent intake, a second vent intake, and a cross pipe fitting, wherein the cross pipe fitting includes a vacuum port, a first vent port, a second vent port, an exit port, and a tapered passage, and the he exit port is designed to be coupled to a pool pump to draw water from a swimming pool simultaneously into the vacuum intake, the first vent intake, and the second vent intake to provide supplemental flow of water in case of a blockage.

BRIEF SUMMARY OF THE INVENTION

An embodiment of the disclosure meets the needs presented above in a swimming pool safety pipe assembly generally comprising a vacuum intake, a vacuum cover, a first vent intake, a second vent intake, and a cross pipe fitting. The vacuum intake is designed to be mounted in a swimming pool wall. The vacuum cover is pivotably coupled to the vacuum intake to selectively open and close the vacuum intake. The first vent intake is designed to be mounted in the swimming pool wall. The second vent intake is designed to be mounted in the swimming pool wall. The cross pipe fitting includes a vacuum port, a first vent port, a second vent port, an exit port, and a tapered passage. The vacuum port is coupled to the vacuum intake. The first vent port is coupled to the first vent intake. The second vent port is coupled to the second vent intake. The exit port is designed to be coupled to a pool pump to draw water from a swimming pool simultaneously into the vacuum intake, the first vent intake, and the second vent intake, through the cross pipe fitting, and to the pool pump. The tapered passage is positioned in the exit port. The tapered passage is designed to receive and seat a tapered end of a vacuum hose inserted through the vacuum intake and into the cross pipe fitting. The exit port is aligned with the vacuum port for insertion of a vacuum hose through the vacuum intake and the vacuum port and into the tapered passage.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
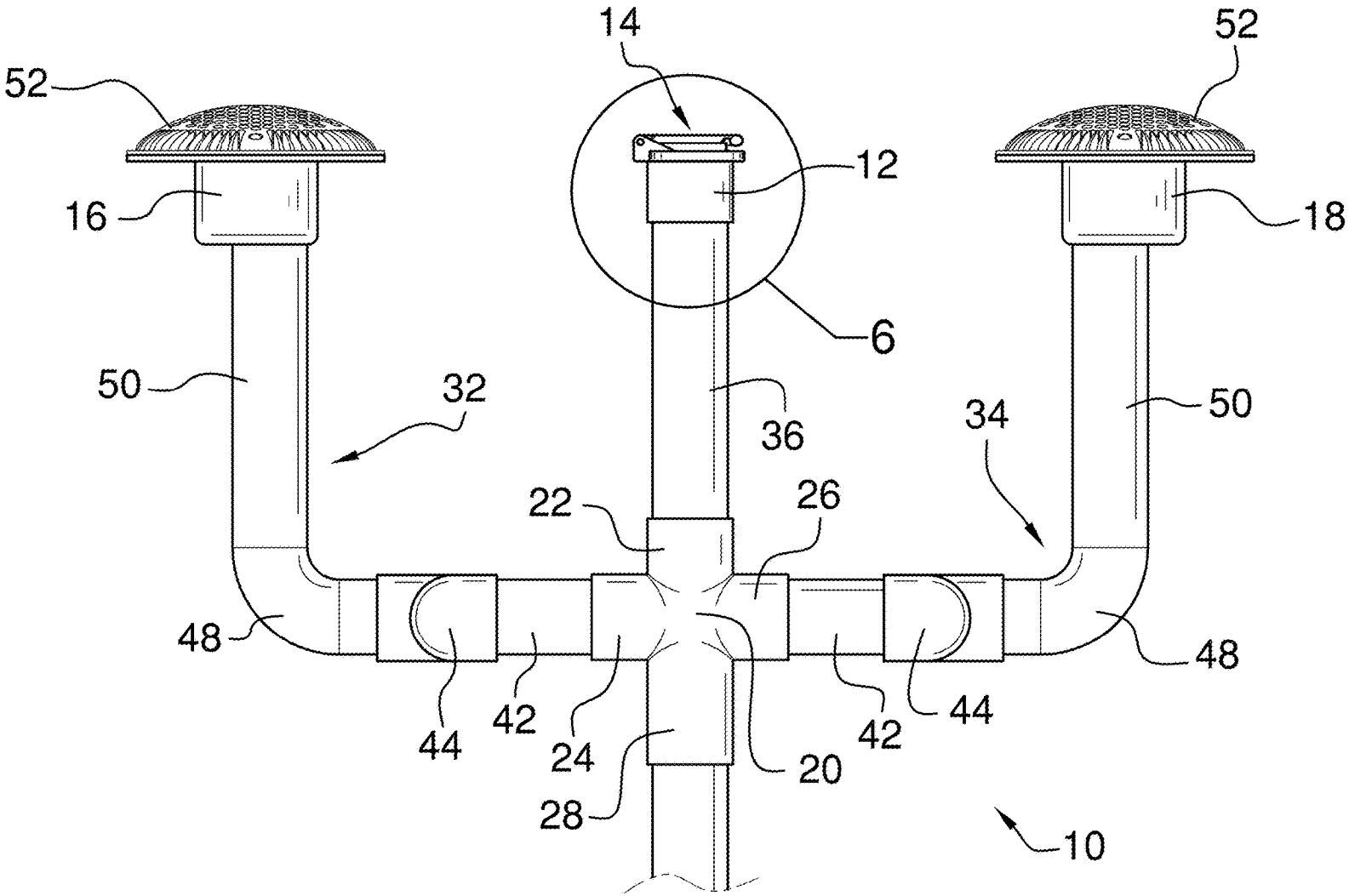
FIG. 1 is a top view of a swimming pool safety pipe assembly according to an embodiment of the disclosure.

With reference now to the drawings, and in particular to FIGS. 1 through 11 thereof, a new swimming pool safety pipe assembly embodying the principles and concepts of an embodiment of the disclosure and generally designated by the reference numeral 10 will be described.

Figure 2:
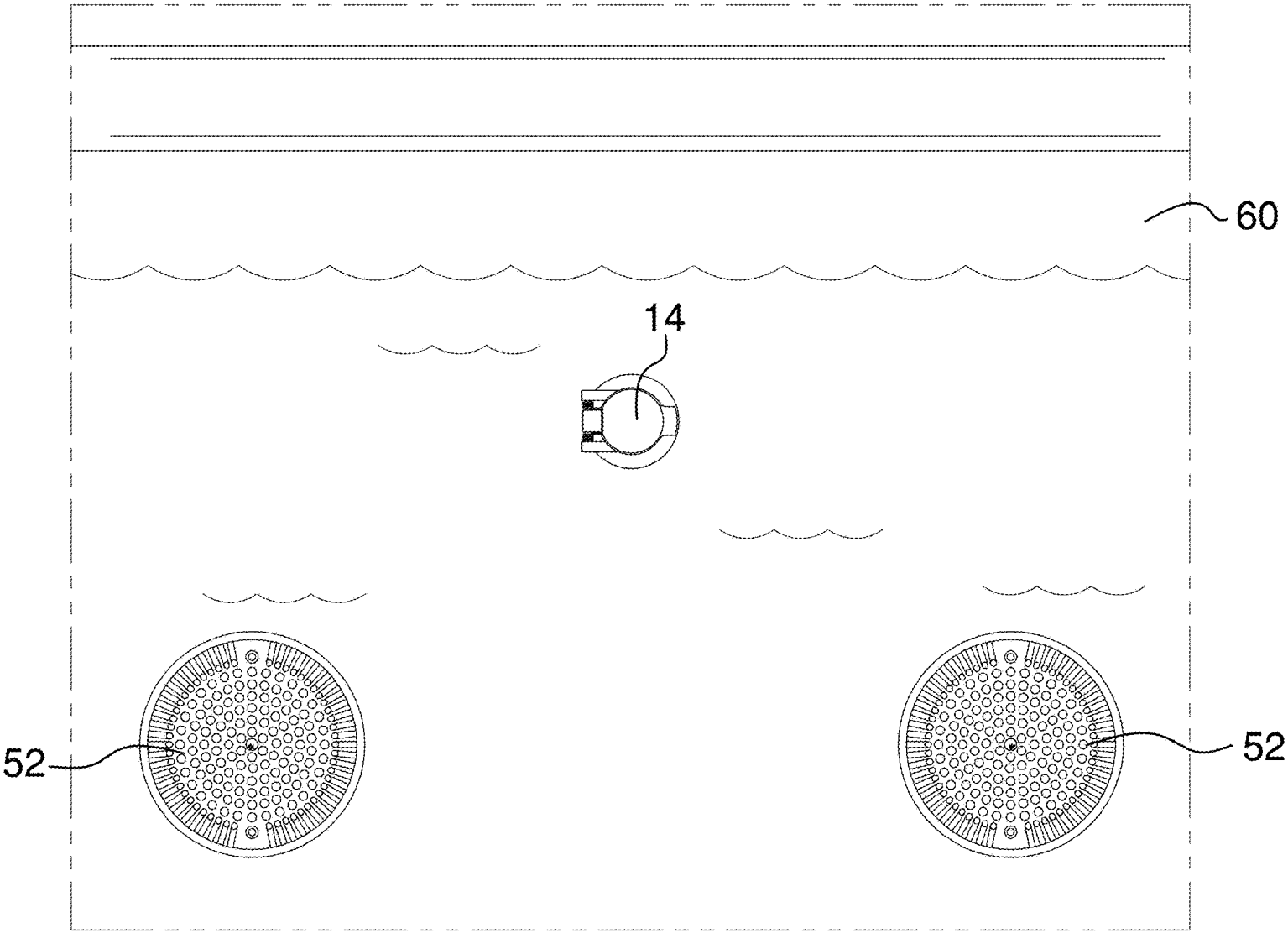
FIG. 2 is a front view of an embodiment of the disclosure installed in a swimming pool wall.
Figure 3:
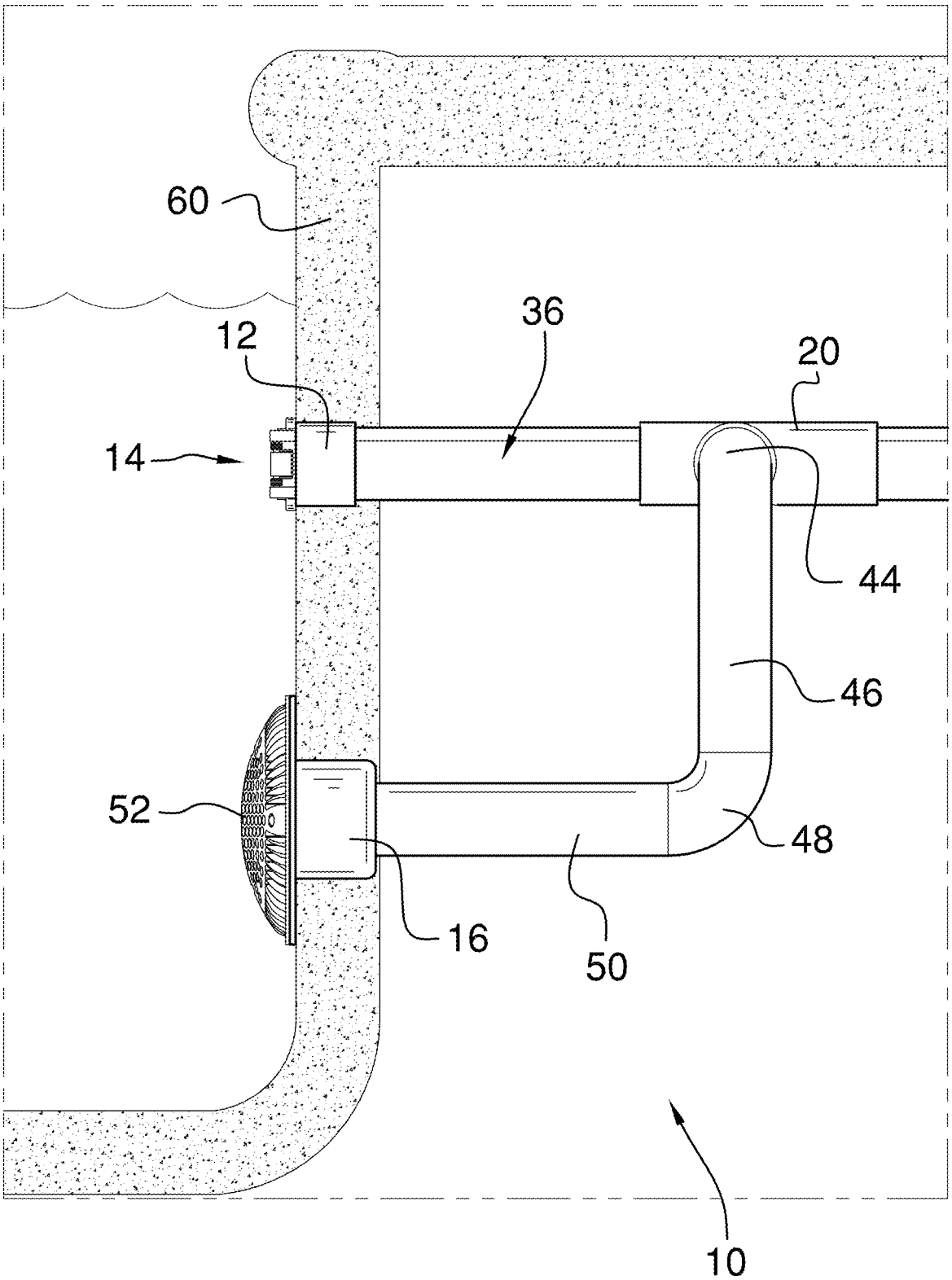
FIG. 3 is a side view of an embodiment of the disclosure installed in the swimming pool wall.
Figure 4:
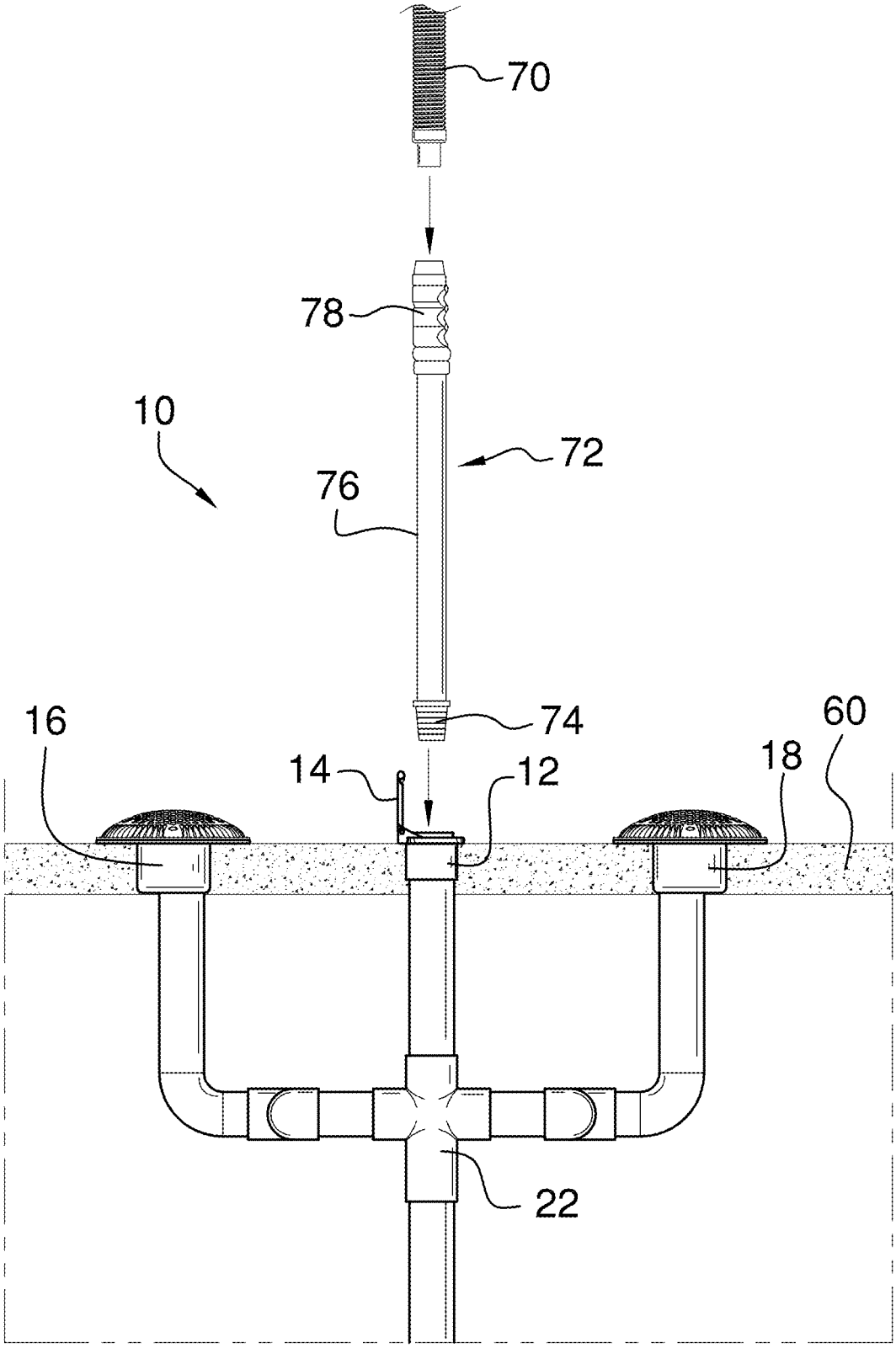
FIG. 4 is an exploded top view of an embodiment of the disclosure.
Figure 5:
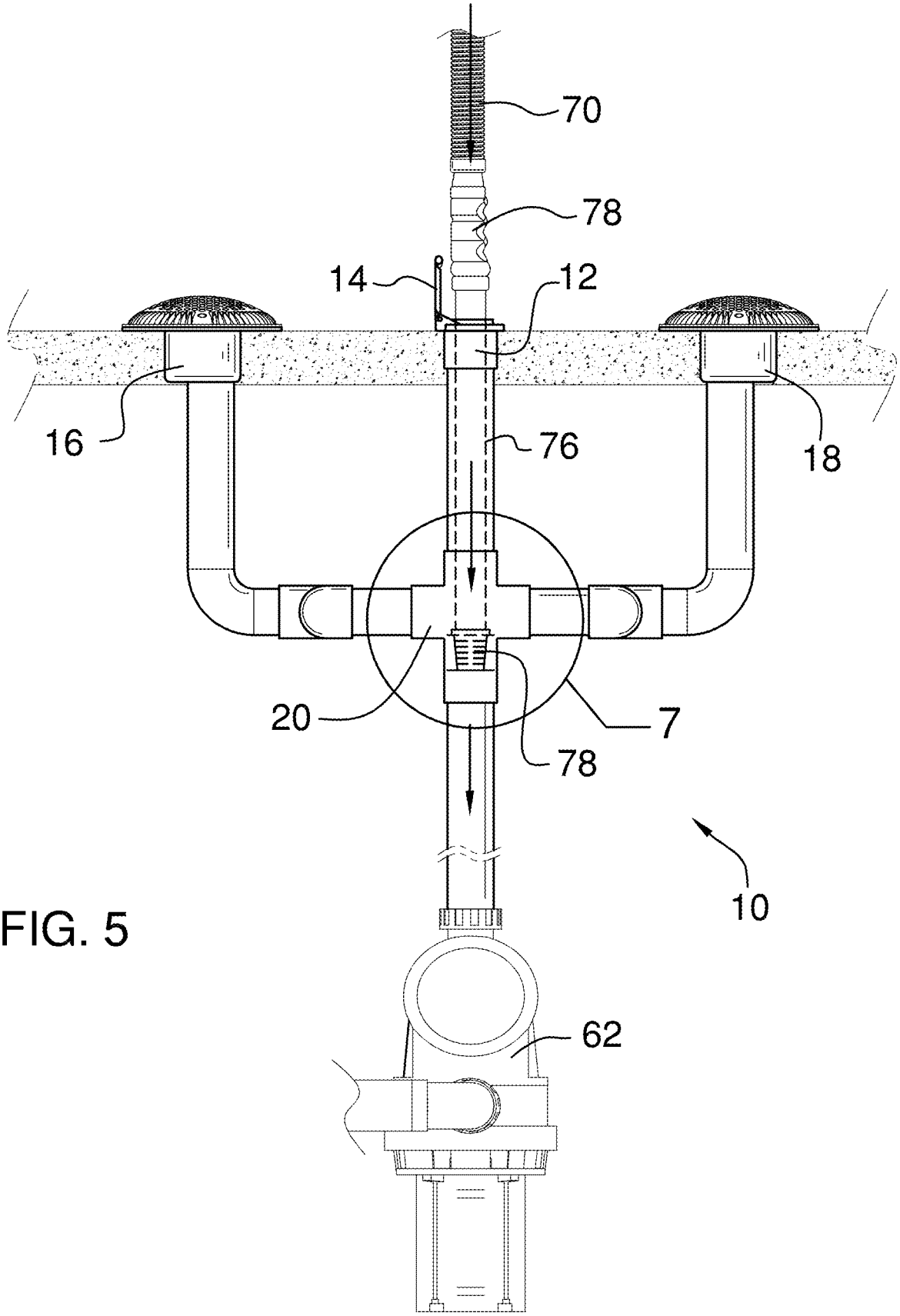
FIG. 5 is a top view of an embodiment of the disclosure in use.
Figure 6:
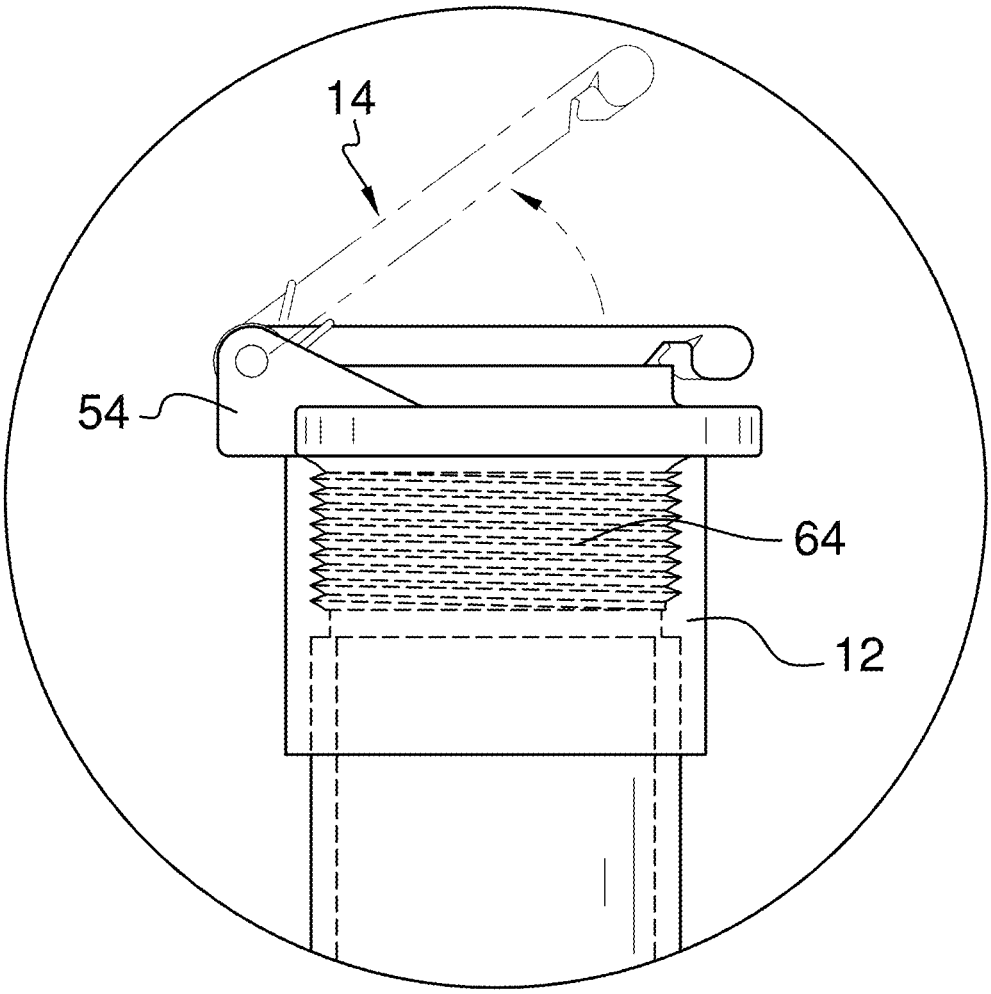
FIG. 6 is a close-up view of a component of an embodiment of the disclosure.

As best illustrated in FIGS. 1 through 11, the swimming pool safety pipe assembly 10 generally comprises a vacuum intake 12, a vacuum cover 14, a first vent intake 16, a second vent intake 18, and a cross pipe fitting 20. The vacuum intake 12 is designed to be mounted in a swimming pool wall 60, as shown in FIGS. 2 and 3. The vacuum cover 14 is pivotably coupled to the vacuum intake 12 to selectively open and close the vacuum intake 12, as shown in FIG. 6. The first vent intake 16 is designed to be mounted in the swimming pool wall 60. The second vent intake 18 is designed to be mounted in the swimming pool wall 60. In the exemplary embodiment in FIG. 7, the cross pipe fitting 20 includes a vacuum port 22, a first vent port 24, a second vent port 26, an exit port 28, and a tapered passage 30. As shown in FIG. 1, the vacuum port 22 is coupled to the vacuum intake 12. The first vent port 24 is coupled to the first vent intake 16. The second vent port 26 is coupled to the second vent intake 18. The exit port 28 is designed to be coupled to a pool pump 62 to draw water from a swimming pool simultaneously into the vacuum intake 12, the first vent intake 16, and the second vent intake 18, through the cross pipe fitting 20, and to the pool pump 62, as shown in FIG. 5. In the exemplary embodiment in FIG. 7, the tapered passage 30 is positioned in the exit port 28. The tapered passage 30 is designed to receive and seat a tapered end of a vacuum hose 70 inserted through the vacuum intake 12 and into the cross pipe fitting 20, as shown in the exemplary embodiment in FIGS. 4 and 5. The exit port 28 is aligned with the vacuum port 22 for insertion of a vacuum hose 70 through the vacuum intake 12 and the vacuum port 22 and into the tapered passage 30.

The swimming pool safety pipe assembly 10 further includes a first vent pipe assembly 32 connecting the first vent intake 16 to the first vent port 24 and a second vent pipe assembly 34 connecting the second vent intake 18 to the second vent port 26. Each of the first vent pipe assembly 32 and the second vent pipe assembly 34 is designed to extend away from the cross pipe fitting 20 such that each of the first vent intake 16 and the second vent intake 18 is positioned at least 16 inches away from the vacuum intake 12 when positioned in the swimming pool wall 60. In addition, each of the first vent pipe assembly 32 and the second vent pipe assembly 34 is designed to extend away from the cross pipe fitting 20 such that the first vent intake 16 is positioned at least 32 inches away from the second vent intake 18 when positioned in the swimming pool wall 60. Other minimum distances, such as the first vent intake 16 and the second vent intake 18 being positioned at least 12 to 24 inches away from the vacuum intake 12, or such as the first vent intake 16 being positioned at least 24-40 inches away from the second vent intake 18, are within the scope of the disclosure. The distance should be selected in order to minimize the chance that a swimmer, especially a child, could block or obstruct both of the first vent intake 16 and the second vent intake 18 simultaneously, thereby minimizing the opportunity for injury.

Figure 7:
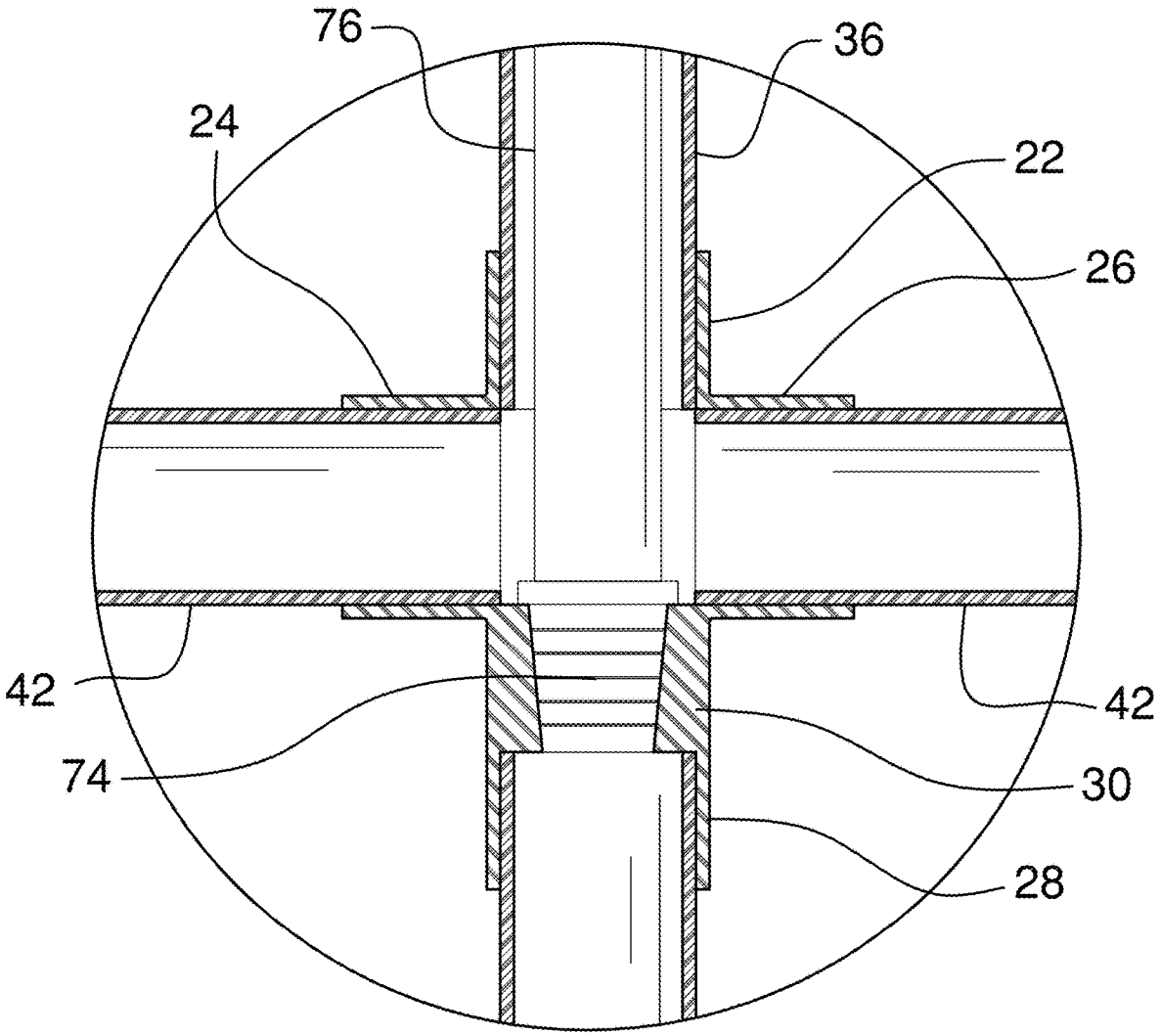
FIG. 7 is a close-up view of a component of an embodiment of the disclosure.

In the exemplary embodiment in FIG. 1, the swimming pool safety pipe assembly 10 further includes a vacuum pipe 36. The vacuum pipe 36 connects the vacuum intake 12 to the vacuum port 22 of the cross pipe fitting 20. As shown in FIGS. 5 and 7, the vacuum hose 70 can be inserted through the vacuum pipe 36 and into the cross pipe fitting 20. In the alternative embodiment shown in FIGS. 10 and 11, the vacuum pipe 36 is omitted and the vacuum intake 12 is integrated into the cross pipe fitting 20. Each of the first vent pipe assembly 32 and the second vent pipe assembly 34 is mountable on the surface of the swimming pool wall 60, and thus only the exit port 28 is within the swimming pool wall 60.

In the exemplary embodiment in FIGS. 1 and 3, each of the first vent pipe assembly 32 and the second vent pipe assembly 34 includes a plurality of straight pipe sections and elbow pipe sections to position each of the first vent intake 16 and the second vent intake 18 offset from the vacuum intake 12 both vertically and horizontally when positioned in the swimming pool wall 60, as shown, for example, in FIG. 2. To further explain, the connection between the cross pipe fitting 20 and the first vent intake 16 and the second vent intake 18 can be accomplished in different ways to achieve different positioning. In the exemplary embodiment, each of the first vent pipe assembly 32 and the second vent pipe assembly 34 includes a first straight pipe section 42 inserted in the cross pipe fitting 20. A first elbow pipe section 44 makes a 90-degree downward turn to a second straight pipe section 46. A second elbow pipe section 48 makes a 90-degree forward turn to a third straight pipe section 50, which finally connects to the respective one of the first vent intake 16 and the second vent intake 18. However, this is only one exemplary embodiment, and the types and positions and angles of the pipes and connections could be varied as desired and as is well known in the plumbing arts.

The swimming pool safety pipe assembly 10 further includes a pair of ventilated covers 52, as are well known in the swimming pool industry. Each of the ventilated covers 52 is mounted on a respective one of the first vent intake 16 and the second vent intake 18.

In the exemplary embodiment in FIG. 6, the vacuum cover 14 includes a resilient hinge 54 to maintain the vacuum cover 14 in sealed connection over the vacuum intake 12 when not propped open by the vacuum hose 70. In another possible embodiment, the vacuum cover 14 could slide in a translating movement into and out of the swimming pool wall 60 to open and close the vacuum intake 12. In this embodiment, the vacuum cover 14 could be spring-loaded to maintain the vacuum cover 14 in sealed connection over the vacuum intake 12 when not held aside by the vacuum hose 70.

Figure 8:
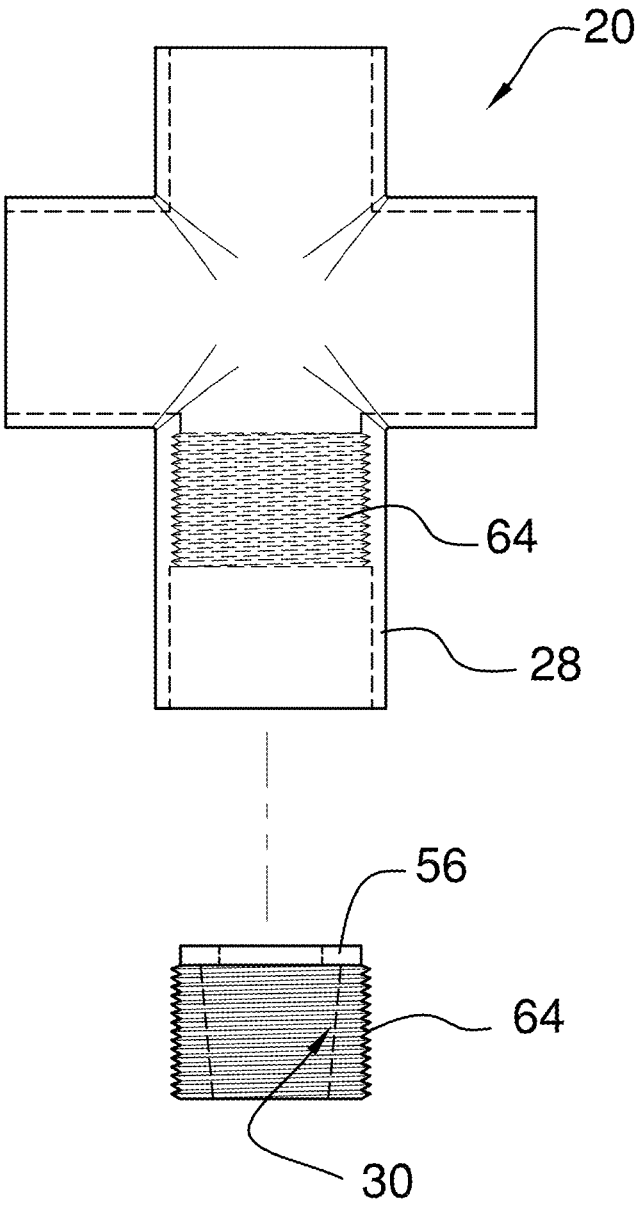
FIG. 8 is a close-up view of a component of an alternative embodiment of the disclosure.
Figure 9:
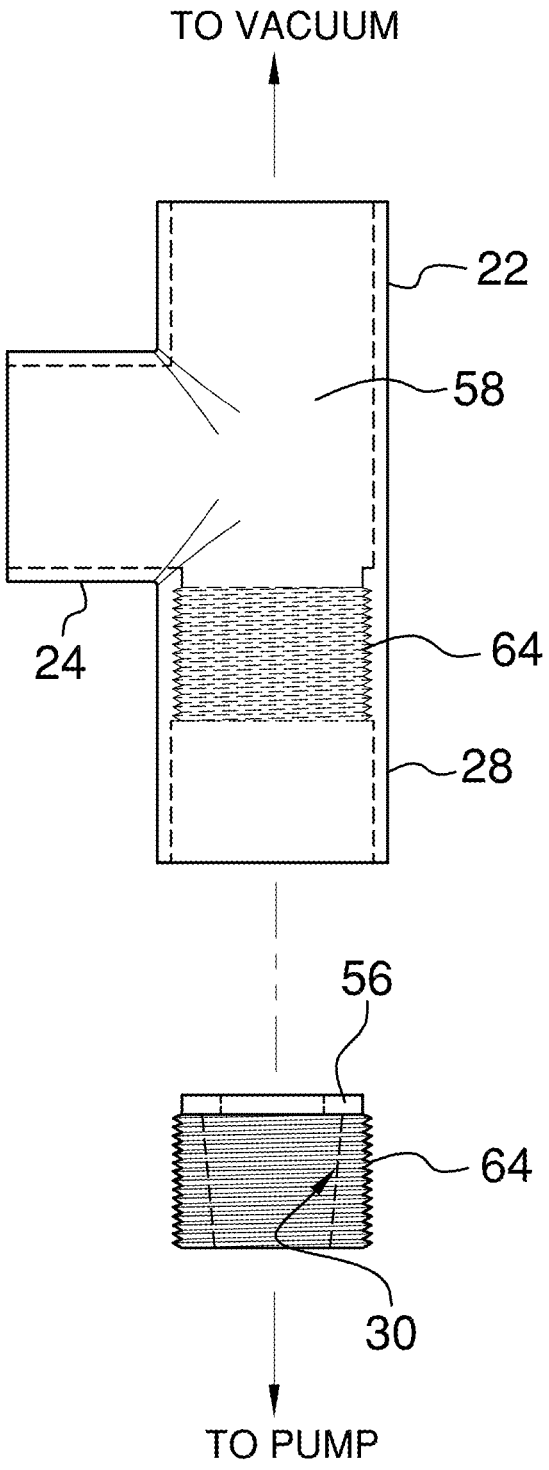
FIG. 9 is a close-up view of a component of an alternative embodiment of the disclosure.
Figure 10:
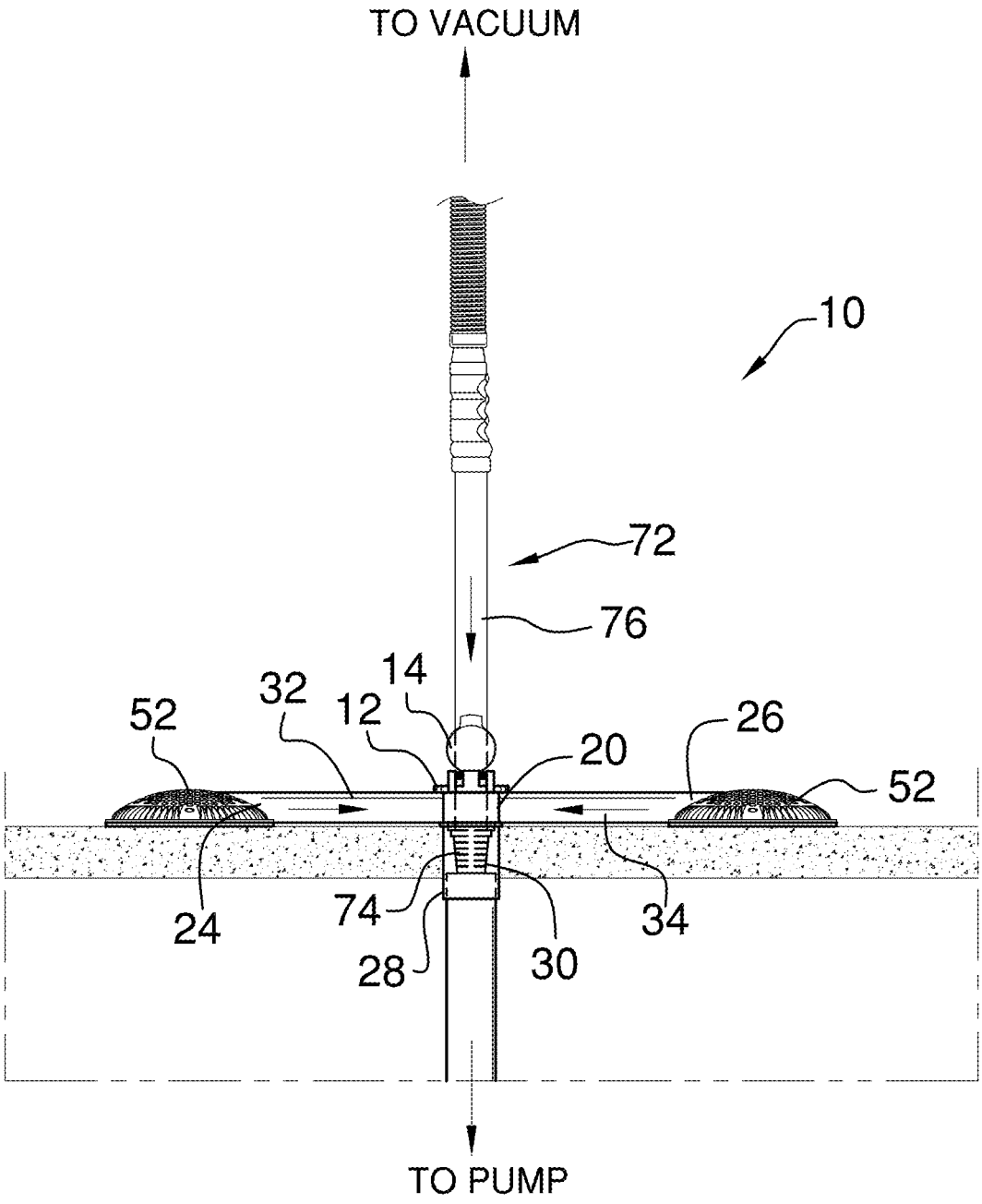
FIG. 10 is a top view of an alternative embodiment of the disclosure.
Figure 11:
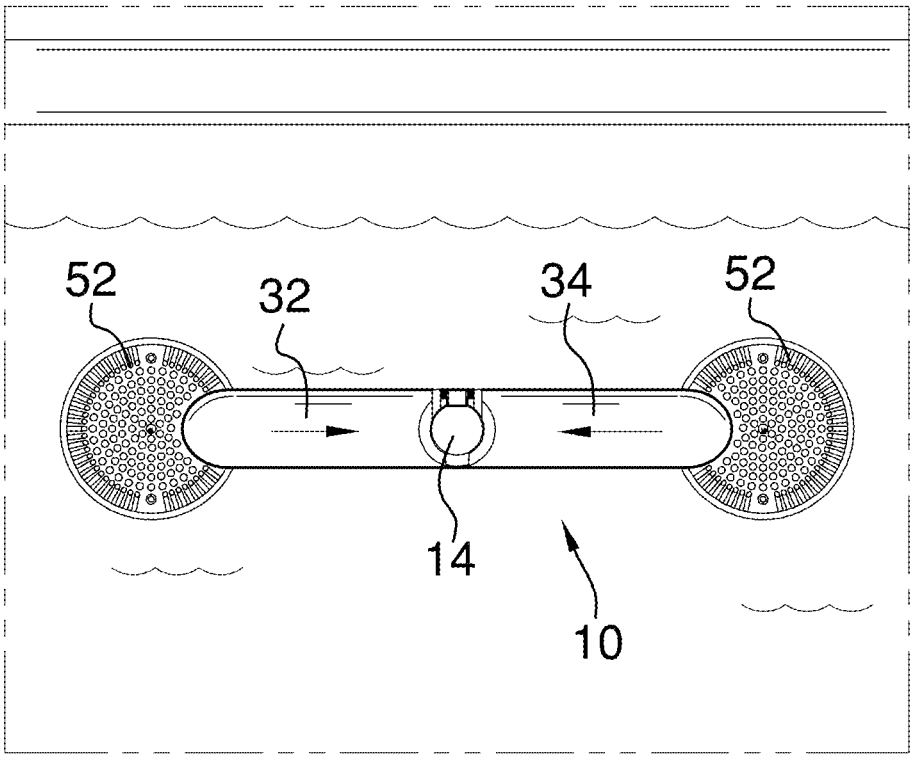
FIG. 11 is a front view of an alternative embodiment of the disclosure.

In the exemplary embodiment in FIGS. 8 and 9, the tapered passage 30 is formed on a pipe insert 56 designed to be removably inserted into the exit port 28, as opposed to being permanently attached to or integrally formed in the cross pipe fitting 20. The pipe insert 56 could be coupled using threading 64 as is well known and shown in FIGS. 8 and 9. The vacuum cover 14 could also be connected by threading 64 to the vacuum port 12.

In one possible embodiment, the cross pipe fitting 20 could be replaced by a T-pipe fitting 58, as shown in FIG. 9. Instead of including the first vent intake 16 and the second vent intake 18, there could be only one to supplement the vacuum intake 12.

In the exemplary embodiment in FIGS. 4 and 5, the swimming pool safety pipe assembly 10 further includes a vacuum hose attachment 72. The vacuum hose attachment 72 is removably inserted in the vacuum pipe 36. The vacuum hose attachment 72 includes a tapered tip 74 to fit into the tapered passage 30, a cylindrical body 76 to fit into the vacuum pipe 36, and a handle section 78 that is connected to the cylindrical body 76 and is designed to be coupled to the tapered end of the vacuum hose 70. In another possible embodiment, the vacuum hose attachment 72 is permanently attached to the vacuum hose 70.

It should be noted that the swimming pool safety pipe assembly 10 could also be installed in a swimming pool floor (not shown), or possibly a combination of both the swimming pool floor and the swimming pool wall 60, wherein, for example, the first intake vent 16 and the second intake vent 18 are installed in the swimming pool wall 60 and the vacuum intake 12 is installed in the swimming pool floor. In addition, the swimming pool safety pipe assembly 10 could possibly be used in other situations or installations than just swimming pools, such as in a system for waste or drainage in a home or commercial environment. It should also be noted that the swimming pool safety pipe assembly 10 is usable in spas and hot tubs.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A swimming pool safety pipe assembly comprising:

a vacuum intake, the vacuum intake being configured to be mounted in a swimming pool wall;

a vacuum cover, the vacuum cover being pivotably coupled to the vacuum intake to selectively open and close the vacuum intake;

a first vent intake, the first vent intake being configured to be mounted in the swimming pool wall;

a second vent intake, the second vent intake being configured to be mounted in the swimming pool wall; and a cross pipe fitting, the cross pipe fitting including:

a vacuum port being coupled to the vacuum intake;

a first vent port being coupled to the first vent intake;

a second vent port being coupled to the second vent intake;

an exit port being configured to be coupled to a pool pump to draw water from a swimming pool simultaneously into the vacuum intake, the first vent intake, and the second vent intake, through the cross pipe fitting, and to the pool pump; and a tapered passage being positioned in the exit port, the tapered passage being configured to receive and seat a tapered end of a vacuum hose inserted through the vacuum intake and into the cross pipe fitting, the exit port being aligned with the vacuum port for insertion of a vacuum hose through the vacuum intake and the vacuum port and into the tapered passage.

2. The swimming pool safety pipe assembly of claim 1, further comprising a first vent pipe assembly connecting the first vent intake to the first vent port and a second vent pipe assembly connecting the second vent intake to the second vent port, each of the first vent pipe assembly and the second vent pipe assembly being configured to extend away from the cross pipe fitting such that each of the first vent intake and the second vent intake is positioned at least 16 inches away from the vacuum intake when positioned in the swimming pool wall.

3. The swimming pool safety pipe assembly of claim 2, wherein each of the first vent pipe assembly and the second vent pipe assembly is configured to extend away from the cross pipe fitting such that the first vent intake is positioned at least 32 inches away from the second vent intake when positioned in the swimming pool wall.

4. The swimming pool safety pipe assembly of claim 3, wherein each of the first vent pipe assembly and the second vent pipe assembly includes a plurality of straight pipe sections and elbow pipe sections to position each of the first vent intake and the second vent intake offset from the vacuum intake both vertically and horizontally when positioned in the swimming pool wall.

5. The swimming pool safety pipe assembly of claim 4, further comprising a pair of ventilated covers, each of the ventilated covers being mounted on a respective one of the first vent intake and the second vent intake.

6. The swimming pool safety pipe assembly of claim 5, wherein the vacuum cover includes a resilient hinge to maintain the vacuum cover in sealed connection over the vacuum intake when not propped open by the vacuum hose.

7. The swimming pool safety pipe assembly of claim 6, further comprising a vacuum pipe, the vacuum pipe connecting the vacuum intake to the vacuum port.

8. The swimming pool safety pipe assembly of claim 7, wherein the tapered passage is formed on a pipe insert configured to be removably inserted into the exit port.

9. The swimming pool safety pipe assembly of claim 8, wherein further comprising a vacuum hose attachment, the vacuum hose attachment being removably inserted in the vacuum pipe, the vacuum hose attachment including a tapered tip to fit into the tapered passage, a cylindrical body to fit into the vacuum pipe, and a handle section being connected to the cylindrical body and being configured to be coupled to the tapered end of the vacuum hose.

10. The swimming pool safety pipe assembly of claim 1, wherein each of the first vent pipe assembly and the second vent pipe assembly is configured to extend away from the cross pipe fitting such that the first vent intake is positioned at least 32 inches away from the second vent intake when positioned in the swimming pool wall.

11. The swimming pool safety pipe assembly of claim 1, wherein each of the first vent pipe assembly and the second vent pipe assembly includes a plurality of straight pipe sections and elbow pipe sections to position each of the first vent intake and the second vent intake offset from the vacuum intake both vertically and horizontally when positioned in the swimming pool wall.

12. The swimming pool safety pipe assembly of claim 1, further comprising a pair of ventilated covers, each of the ventilated covers being mounted on a respective one of the first vent intake and the second vent intake.

13. The swimming pool safety pipe assembly of claim 1, wherein the vacuum cover includes a resilient hinge to maintain the vacuum cover in sealed connection over the vacuum intake when not propped open by the vacuum hose.

14. The swimming pool safety pipe assembly of claim 1, further comprising a vacuum pipe, the vacuum pipe connecting the vacuum intake to the vacuum port.

15. The swimming pool safety pipe assembly of claim 1, wherein the tapered passage is formed on a pipe insert configured to be removably inserted into the exit port.

16. The swimming pool safety pipe assembly of claim 1, wherein further comprising a vacuum hose attachment, the vacuum hose attachment being removably inserted in the vacuum pipe, the vacuum hose attachment including a tapered tip to fit into the tapered passage, a cylindrical body to fit into the vacuum pipe, and a handle section being connected to the cylindrical body and being configured to be coupled to the tapered end of the vacuum hose.

17. A method of installing a swimming pool safety pipe assembly to protect swimmers from injury by suction force, the method comprising the steps of:

providing a swimming pool safety pipe assembly comprising:

a vacuum intake, the vacuum intake being configured to be mounted in a swimming pool wall;

a vacuum cover, the vacuum cover being pivotably coupled to the vacuum intake to selectively open and close the vacuum intake;

a first vent intake, the first vent intake being configured to be mounted in the swimming pool wall;

a second vent intake, the second vent intake being configured to be mounted in the swimming pool wall; and a cross pipe fitting, the cross pipe fitting including:

a vacuum port being coupled to the vacuum intake;

a first vent port being coupled to the first vent intake;

a second vent port being coupled to the second vent intake;

an exit port being configured to be coupled to a pool pump to draw water from a swimming pool simultaneously into the vacuum intake, the first vent intake, and the second vent intake, through the cross pipe fitting, and to the pool pump; and a tapered passage being positioned in the exit port, the tapered passage being configured to receive and seat a tapered end of a vacuum hose inserted through the vacuum intake and into the cross pipe fitting, the exit port being aligned with the vacuum port for insertion of a vacuum hose through the vacuum intake and the vacuum port and into the tapered passage;

positioning the vacuum intake in the swimming pool wall;

positioning the first vent intake and the second vent intake in the swimming pool wall at least 16 inches away from the vacuum intake; and positioning the first vent intake at least 32 inches away from the second vent intake.

* * * * *